US010920298B2

(12) United States Patent
Liu et al.

(10) Patent No.: US 10,920,298 B2
(45) Date of Patent: Feb. 16, 2021

(54) GOOD FATIGUE- AND CRACK GROWTH-RESISTANT STEEL PLATE AND MANUFACTURING METHOD THEREFOR

(71) Applicant: BAOSHAN IRON & STEEL CO., LTD., Shanghai (CN)

(72) Inventors: Zicheng Liu, Shanghai (CN); Qing Shi, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 395 days.

(21) Appl. No.: 15/536,949

(22) PCT Filed: Nov. 4, 2015

(86) PCT No.: PCT/CN2015/093743
§ 371 (c)(1),
(2) Date: Jun. 16, 2017

(87) PCT Pub. No.: WO2016/095616
PCT Pub. Date: Jun. 23, 2016

(65) Prior Publication Data

US 2018/0258507 A1 Sep. 13, 2018

(30) Foreign Application Priority Data

Dec. 19, 2014 (CN) ..... 201410815614.5

(51) Int. Cl.
*C21D 9/46* (2006.01)
*C22C 38/14* (2006.01)
(Continued)

(52) U.S. Cl.
CPC ..... *C21D 9/46* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS 8,702,880 B2 * 4/2014 Cho ..... C22C 38/02 148/330

FOREIGN PATENT DOCUMENTS

CN 1957100 A 5/2007
CN 103108971 A 5/2013
(Continued)

OTHER PUBLICATIONS

Machine Translation of JP-2009263685-A (Year: 2009).*
(Continued)

*Primary Examiner* — Paul A Wartalowicz
*Assistant Examiner* — Ryan L Heckman
(74) *Attorney, Agent, or Firm* — Thomas Horstemeyer, LLP

(57) ABSTRACT

A steel plate having excellent resistance to fatigue crack growth and manufacturing method thereof, wherein the components of the steel plate in weight percentage are: 0.040-0.070% of C, 0.40-0.70% of Si, 1.30-1.60% of Mn, less than or equal to 0.013% of P, less than or equal to 0.003% of S, less than or equal to 0.30% of Cu, less than or equal to 0.30% of Ni, less than or equal to 0.10% of Mo, 0.008-0.018% of Ti, 0.015-0.030% of Nb, less than or equal to 0.0040% of N, 0.0010-0.0040% of Ca, and the balance being Fe and inevitable impurities. By controlling [% C]×[% Si] between 0.022-0.042, {([% C]+3.33[% Nb])×[% Si]}× $V_{cooling\ rate}/T_{cooling\text{-}stopping}$ between $1.15\times10^{-4}$~$2.2\times10^{-3}$, carrying out a Ca treatment, and Ca/S=1.0-3.0 and (% Ca)×(% S) $0.28\leq1.0\times10^{-3}$, the optimizing the TMCP process, the finished steel plate has a microstructure which a duplex-phase structure of ferrite+uniformly and dispersedly
(Continued)

distributed bainite and has an improved resistance to fatigue crack growth.

5 Claims, 1 Drawing Sheet

(51) Int. Cl.

| | |
|---|---|
| ***C22C 38/16*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |

(52) U.S. Cl.

CPC ..... *C21D 8/0263* (2013.01); *C22C 38/001* (2013.01); *C22C 38/002* (2013.01); *C22C 38/02* (2013.01); *C22C 38/04* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01)

(56) References Cited

FOREIGN PATENT DOCUMENTS

| | | | | |
|---|---|---|---|---|
| CN | 104561796 | A | | 4/2015 |
| JP | H07 278664 | | | 10/1995 |
| JP | H08 225831 | | | 9/1996 |
| JP | H11 302776 | | | 11/1999 |
| JP | 2001 064728 | | | 3/2001 |
| JP | 2003155541 | A | | 5/2003 |
| JP | 2009263685 | A | * | 11/2009 |
| WO | 2009/066863 | | | 5/2009 |

OTHER PUBLICATIONS

EP Communication dated Jun. 21, 2018 for EP App No. 15869126.1.

PCT/CN2015/093743 International Search Report and Written Opinion, dated Jan. 27, 2016.

* cited by examiner

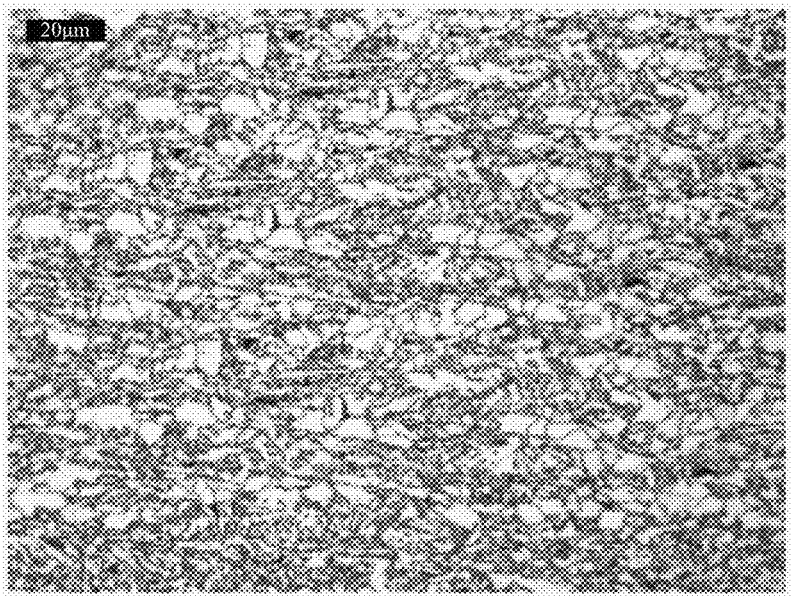
20μm

GOOD FATIGUE- AND CRACK GROWTH-RESISTANT STEEL PLATE AND MANUFACTURING METHOD THEREFOR

CROSS-REFERENCE TO RELATED APPLICATIONS

This application is a 371 U.S. National Phase of PCT International Application No. PCT/CN2015/093743, filed on Nov. 4, 2015, which claims benefit and priority to Chinese patent application No. 201410815614.5, filed on Dec. 19, 2014. Both of the above-referenced applications are incorporated by reference herein in their entirety.

TECHNICAL FIELD

The present invention relates to an steel plate having excellent resistance to fatigue crack growth and a method for manufacturing same, the steel plate being a fatigue crack growth-resistant steel plate having a yield strength of ≥385 MPa, a tensile strength of 520-630 MPa, a Charpy impact energy (single value) at −40° C. of ≥80 J, and an excellent weldability ($da/dN \leq 3.0\times10^{-8}$ under the conditions of $\Delta K=8$ $MPa\cdot m^{1/2}$).

BACKGROUND ART

As well known, low-carbon (high-strength) low-alloy steel is one of the most important engineering structure materials and is widely used in petroleum and natural gas pipelines, offshore platforms, shipbuilding, bridge structures, boilers and pressure vessels, building structures, the automobile industry, railway transportations and machinery manufacturing. The performance of the low-carbon (high strength) low-alloy steel depends on its chemical composition and the process system in the manufacturing process, wherein the strength, toughness and weldability are the most important properties of the low-carbon (high strength) low-alloy steel, and it is eventually determined by the microstructure condition of finished steel. With the continuous progressive development of science and technology, higher requirements are raised in the strength-toughness and weldability of steel, that is, the overall mechanical properties and the usability of the steel plate are improved while maintaining a lower manufacturing cost so as to reduce the amount of steel for saving costs, reduce the body weight of a steel component, and provide stability and a safety. A research climax to develop a new generation of high-performance steel materials is raised currently worldwide, wherein by way of alloy combination designing, innovative controlled rolling/TMCP technology and a heat treatment process to obtain a better microstructure matching, such that a steel plate is endowed with more excellent strength-toughness, strength-plasticity matching, resistance to seawater corrosion, more excellent weldability and fatigue resistance; Since the above-mentioned technology is used in the steel plate of the invention, a fatigue crack growth-resistant thick steel plate having strength-toughness and strength-plasticity matching and excellent weldability is developed at a low cost.

The microstructures of the existing thick steel plates with a yield strength of ≥415 MPa mainly include ferrite+pearlite, or ferrite+pearlite (including metamorphic pearlite)+a small amount of bainite; the production processes include normalization, normalizing rolling, thermomechanical rolling and TMCP; the strength, (ultra-) low-temperature toughness, weldability, hot and cold processing characteristics of the steels are all relatively excellent, and the steel plates are widely suitable in building structures, bridge structures, hull structures, offshore platforms and other large heavy steel structures (The Firth (1986) international Symposium and Exhibit on Offshore Mechanics and Arctic Engineering, 1986, Tokyo, Japan, 354; "Steel plates for offshore platform structures used in ice sea areas" (in Japanese), Research on Iron and Steel, 1984, no. 314, 19-43; and U.S. Pat. No. 4,629,505, WO 01/59167 A1); however, the steel plates do not relate to the fatigue crack growth-resistance.

Thick steel plates FCA with excellent weldability, fatigue crack growth-resistance and a yield strength grade of 355 MPa successfully developed by Japan Sumitomo Metal (such as "fatigue crack growth-inhibiting steel plate" disclosed in Japanese Patent Application Laid-Open No. 3298544; "thick steel plates with excellent fatigue crack growth-inhibiting properties" disclosed in Japanese Laid-Open Patent Application No. 10-60575) have achieved good practical results and bulk supply; however, the steel plate development does not relate to thickness steel plates of a higher strength grade.

SUMMARY OF THE INVENTION

An object of the present invention is to provide a steel plate having excellent resistance to fatigue crack growth and a method for manufacturing same, the steel plate being a fatigue crack growth-resistant steel plate having a yield strength of ≥385 MPa, a tensile strength of 520-630 MPa, a Charpy impact energy (single value) at −40° C. of ≥80 J, and excellent weldability ($da/dN \leq 3.0\times10^{-8}$ under the conditions of $\Delta K=8$ $MPa\cdot m^{1/2}$), the microstructure of the finished steel plate being a duplex-phase structure of ferrite+uniformly and dispersedly distributed bainite and having an average grain size of 10 μm or less. The obtained characteristics of high strength, high toughness, excellent weldability and fatigue crack growth-resistance are particularly applicable to hull structures, offshore platforms, bridge structures, building structures, marine wind tower structures, marine machineries and the like in ice sea areas, and can achieve low-cost, stable bulk industrial productions.

Fatigue crack growth-resistant steel plates are one of the most difficult kinds among thick plate products, and the reason is that this kind of steel plate not only requires ultra-low C, low carbon equivalent Ceq, high strength and excellent low temperature toughness, but also shall have excellent fatigue resistance characteristics, especially the steel plate can resist fatigue and crack growth, achieving fatigue crack bending and passivation, improving the fatigue resistance properties of the steel plate, which thus requires a certain quantity, a hardness ratio (bainite/ferrite) and uniformly distributed bainite; how to achieve the two-phase structure of bainite+ferrite (F+B) and control the quantity, hardness, morphology and distribution of bainite so as to achieve a balance between ultra-low C and low carbon equivalent Ceq and the properties of high strength, excellent low temperature toughness and excellent fatigue crack growth-resistance is one of the greatest difficulties for the product of the present invention and is also a key core technology; Therefore, in terms of key technical route, composition and process designing, the invention integrates key factors affecting the strength, the low temperature toughness, the weldability, especially the fatigue crack growth-resistance and other characteristics of a steel plate, and successfully avoids the technical blockade in patents of the Sumitomo Corporation, wherein a TMCP process is optimized starting with alloy composition designing, by creatively using ultra-low carbon C-high Si-medium Mn-Nb-based low alloy steel as a basis, wherein [% C]×[% Si] is controlled between 0.022 and 0.042, $\{([\%\ C]+3.33[\%\ Nb])\times[\%\ Si]\}\times V_{cooling\ rate}/T_{cooling\text{-}stopping}$ is controlled between $1.15\times10^{-4}$ and $2.2\times10^{-3}$, and a Ca treatment is carried out, with the Ca/S ratio controlled between 1.0 and 3.0 and $(\%\ Ca)\times(\%\ S)^{0.28}\leq1.0\times10^{-3}$, so that the microstructure of the finished steel plate is a duplex-phase structure of ferrite+uniformly and dispersedly distributed bainite and has an average grain size of 10 μm or less.

In order to achieve the above-mentioned object, the technical solution of the present invention is:

A steel plate having excellent resistance to fatigue crack growth, the components of the steel plate in weight percentage being: 0.040-0.070% of C, 0.40-0.70% of Si, 1.30-1.60% of Mn, P≤0.013%, S≤0.003%, Cu≤0.30%, Ni≤0.30%, Mo≤0.10%, 0.008-0.018% of Ti, 0.015-0.030% of Nb, N≤0.0040%, 0.0010-0.0040% of Ca, and the balance being Fe and inevitable inclusions; with the contents of the foregoing elements having to meet all the following relationships:

[% C]×[% Si] is controlled at 0.022 to 0.042; and A) the medium temperature phase transition temperature zone is expanded, and the formation of ferrite+bainite complex phase structure is promoted; B) slab segregation in the solidification process is controlled to ensure the intrinsic quality "three properties" (integrity, homogeneity and purity) of the steel plate; and C) carbide precipitation in the phase transition process from austenite to ferrite is inhibited and two-phase separation phase transition of ferrite+bainite (F+B) is promoted, so as to form a duplex-phase structure of ferrite+bainite; wherein all the above three points can improve the fatigue crack growth-inhibiting capability. (wherein upon calculation, [% C] and [% Si] represent a direct substitution with numerical values, for example, if 0.04 is taken for C and 0.70 is taken for Si, then [% C]×[% Si]=0.04×0.70=0.028, hereinafter inclusive)

$\{([\%\ C]+3.33[\%\ Nb])\times[\%\ Si]\}\times V_{cooling\ rate}/T_{cooling\text{-}stopping}$ is controlled in a range of $1.15\times10^{-4}$ to $2.2\times10^{-3}$, wherein $V_{cooling\ rate}$ is the average rate of accelerated cooling in a controlled rolling and controlled cooling process (TMCP), in unit K/s; $T_{cooling\text{-}stopping}$ is the cooling-stopping temperature of accelerated cooling in the controlled rolling and controlled cooling process (TMCP), in unit K; with the TMCP process ensured, a two-phase structure of bainite+ferrite (F+B) is formed; more importantly, the quantity, size, morphology and hardness of bainite all satisfy the fatigue crack growth-inhibiting characteristics:

A) when a fatigue crack grows to bainite, bending and turning occur, forcing the consumption of more energy in the fatigue crack growth process, thereby improving the fatigue crack growth-inhibiting capability; and B) when the fatigue crack grows to bainite, dislocations in a crack tip plastic zone reacts with dislocations in the bainite (cancellation and recombination of dislocations), reducing the intensity factor of the fatigue crack tip stress field, promoting the passivation of the fatigue crack tip and suppressing the further growth of the fatigue crack.

A Ca treatment is carried out, with the Ca/S ratio controlled between 1.0 and 3.0 and $Ca\times S^{0.28}\leq1.0\times10^{-3}$:Ca(O,S) particles are uniformly and finely distributed in the steel, the grain size of the steel plate is refined, the fatigue crack growth-resistance property of the steel plate is improved, and the austenite grain growth in a welding heat affected zone is inhibited, improving the weldability of the steel plate, while ensuring that the sulphide is spheroidized and the effects of the inclusions on low temperature toughness and weldability is minimized.

In the composition system design of the steel plate of the present invention,

As an important alloy element in steel, C plays an important role in improving the strength of the steel plate and promoting the formation of a second phase bainite, so that the steel necessarily contains a certain quantity of C; however, when the C content in the steel is too high, an internal segregation in the steel plate is deteriorated (especially in the case of a high Si content), and the low temperature toughness and the weldability of the steel plate are reduced, which is adverse to the control of the hardness, morphology, quantity and distribution of the second phase bainite, and the weldability, low temperature toughness and fatigue crack-growth resistance properties of the steel plate are deteriorated seriously; therefore, a suitable content of C is controlled in a range of 0.040% to 0.070%.

Not only does Si improve the strength of the steel plate, but also more importantly, Si expands the medium temperature phase transition zone, inhibits the precipitation of carbides, facilitates the formation of the two-phase of ferrite+bainite (F+B), facilitates the control of the quantity, morphology, hardness and distribution of bainite, and thus Si is an indispensable alloy element for the fatigue crack growth resistant steel plates; however, when the Si content of the steel is too high, the segregation, low temperature toughness and weldability of the steel plate will be deteriorated seriously; therefore, a suitable content of Si is controlled in a range of 0.40% to 0.70%.

In addition to improving the strength of the steel plate, Mn as the most important alloy element in steel further has an effect of expanding the austenite phase zone, lowering the $Ar_3$ point temperature and refining bainite grain groups in the TMCP steel plate, thereby improving the low temperature toughness of the steel plate, facilitating the formation of bainite; however, Mn segregation is prone to occur during the solidification of molten steel; especially when the Mn content is higher, which not only can cause a difficult in casting operations, but also easily results in a conjugate segregation phenomenon with C, P, S and other elements, and especially when the C content in steel is higher, the segregation and loosening in the central part of the cast slab are aggravated, and severe segregation in the central area of the cast slab easily causes the formation of abnormal structures in the subsequent rolling, heat treatment and welding processes, leading to the deterioration of the low temperature toughness of the steel plate, the occurrence of cracks in welded joints and a low fatigue crack growth resistance capability; therefore, a suitable content of Mn is 1.30% to 1.60%.

P as a harmful inclusion in steel has a great damage impact on the low temperature impact toughness, elongation, weldability and fatigue crack growth resistance properties of steel, and is theoretically required to be as low as possible; however, considering the steelmaking operability and the steelmaking cost, the P content is controlled at ≤0.013%.

S as a harmful inclusion (mainly as long strip-like sulphides) in steel has a great damage impact on the low temperature toughness and fatigue crack growth resistance properties; more importantly, S is bonded to Mn in steel to form MnS inclusions, and in the hot rolling process, the plasticity of MnS allows MnS to extend in the rolling direction to form MnS inclusion belts in the rolling direction, which seriously damages the low temperature impact toughness, the fatigue crack growth resistance property, the elongation, the Z-direction properties and the weldability of the steel plate; furthermore, S is also the main element for the production of hot brittleness in the hot rolling process and is theoretically required to be as low as possible; however, considering the steelmaking operability, the steelmaking cost and the principle of a smooth material flow, the S content is controlled at ≤0.0030%.

In the present invention, according to the thickness of the steel plate, Cu, Ni and Mo in suitable amounts, i.e., ≤0.30% Cu, ≤0.30% Ni and ≤0.10% Mo, can be added, to facilitate the formation of bainite in the TMCP process, and the quantity, morphology, distribution condition and hardness of bainite are controlled so as to improve the strength, low temperature toughness and fatigue crack growth-resistance properties.

The affinity between Ti and N is very great; when Ti is added in a small amount, N is bonded preferentially to Ti to produce dispersedly distributed TiN particles, suppressing the excessive growth of austenite grains in the slab heating and hot rolling processes, improving the low temperature toughness of the steel plate; more importantly, the grain growth in a heat affected zone (a region far from a fusion line) in the great heat input welding process is suppressed to a certain extent, improving the toughness in the heat affected zone; there is little effect when the content of Ti added is too little (0.008%); when the content of Ti added exceeds 0.018%, a further increase in the Ti content in steel has little effect in both refining grains of the steel plate and improving the effect of the weldability of the steel plate, and even when TiN is too great, the addition of Ti is adverse to the grain refinement in the steel plate and even deteriorates the weldability of the steel plate; therefore, a suitable content of Ti is in a range of 0.008% to 0.018%.

The purpose of adding a trace amount of element Nb into the steel is to carry out non-recrystallization controlled rolling, promote the formation of bainite, refine the microstructure of the steel plate, improve the strength and toughness of the TMCP steel plate, and improve the fatigue crack growth resistance property of the steel plate; when the addition amount of Nb is less than 0.015%, the controlled rolling effect cannot effectively work; besides, the capacity in the formation of bainite in the TMCP steel plate is smaller, and the phase transition strengthening ability is also deficient; and when the addition amount of Nb exceeds 0.030%, the weldability of the steel plate is seriously damaged; therefore, the content of Nb is controlled between 0.015% and 0.030%.

The control range of N corresponds to the control range of Ti, and in order to improve the grain refinement effect for the steel plate and improve the weldability of the steel plate, Ti/N is optimally between 1.5 and 3.5. When the content of N is too low and the content of Ti is too high, the TiN particles generated is in a small number and a large size, which cannot have an effect of improving the weldability and grain refinement of the steel, and on the contrary is harmful to the weldability and grain refinement of the steel plate; however, when the content of N is too high, the content of free [N] in the steel increases, and especially under conditions of high input energy welding, the content of free [N] in the heat affected zone (HAZ) increases sharply, which seriously damages the low temperature toughness of HAZ and deteriorates the weldability of the steel; moreover, when the N content is higher, cracks in the slab surface are serious, leading to slab scrapping in severe cases. Therefore, the N content is controlled at ≤0.0040%.

The steel is subjected to a Ca treatment, which on one hand can further purify the molten steel, and on the other hand can perform denaturating treatment on sulphides in the steel, making same become non-deformable, stable and fine spherical sulphides, inhibiting the hot brittleness of S, improving the low temperature toughness of the steel plate, improving the fatigue crack growth resistance property, elongation and Z-direction properties of the steel plate, and improving the anisotropism of toughness of the steel plate. The addition amount of Ca depends on the content of S in the steel, wherein when the addition amount of Ca is too low, the treatment effect will not be significant; and when the addition amount of Ca is too high, the formed Ca(O,S) is oversized and the brittleness is also increased, and can become a starting point of a fractural crack, not only reducing the low temperature toughness and elongation of the steel plate, but also reducing the steel purity, polluting the molten steel, and deteriorating the fatigue crack growth resistance property of the steel plate; therefore, a suitable content of Ca is in a range of 0.0010% to 0.0040%.

The method for manufacturing excellent fatigue crack growth-resistance steel plate of the present invention is characterized by comprising the following steps:

1) Smelting and casting

Smelting and casting are carried out according to the components in claim 1 to form a slab;

2) Slab heating: the heating temperature is controlled between 1050° C. and 1130° C.;

3) Rolling: the overall compression ratio of the steel plate, i.e., slab thickness/finished steel plate thickness, is ≥4.0;

the first stage is normal rolling;

the second stage is carried out using non-recrystallization controlled rolling, with a starting rolling temperature being controlled at 780-840° C., a rolling pass reduction rate being ≥7%, an accumulated reduction rate being ≥60% and a finishing rolling temperature being 760-800° C.; and 4) Cooling after the completion of the controlled rolling, the steel plate is subjected to accelerated cooling, with a starting cooling temperature of the steel plate being 750-790° C., a cooling rate being ≥6° C./s and a cooling-stopping temperature being 400-600° C.; and subsequently the steel plate is air-cooled to 350° C.±25° C. naturally, followed by a slow cooling process in which the steel plate is maintained at a temperature for at least 24 hours at which the temperature of the surface of the steel plate is greater than or equal to 300° C.

In the manufacturing method of the present invention:

According to the content ranges of C, Mn, Nb and Ti in the steel composition, the heating temperature of the slab is controlled between 1050° C. and 1130° C., so that austenite grains in the slab do not grow abnormally while ensuring the complete solid solution of Nb in the steel into austenite in the slab heating process.

The overall compression ratio (slab thickness/finished steel plate thickness) of the steel plate is ≥4.0, ensuring that the rolling deformation occurs even in the core of the steel plate to improve the microstructure and properties of the central part of the steel plate.

The first stage is normal rolling, wherein continuous, ceaseless rolling is carried out within the rolling capability of a rolling mill, ensuring that recrystallization occurs to the deformed steel slab, refining the austenite grains, while maximumly increasing the rolling line production capacity.

the second stage is carried out using non-recrystallization controlled rolling, wherein according to the content range of element Nb in the above-mentioned steel, the starting rolling temperature is controlled at 780-840° C., the rolling pass reduction rate is ≥7%, the accumulated reduction rate is ≥60% and the finishing rolling temperature is 760-800° C., in order to control the effect of the non-recrystallization controlled rolling.

The present invention has the following beneficial effects:

The steel plate of the present invention is obtained by a simple component combination design in conjunction with the TMCP manufacturing process, which not only produces a fatigue crack growth-resistant TMCP steel plate with an excellent overall performance at a low cost, but also substantially shortens the steel plate manufacturing cycle, creating a tremendous value for enterprises, achieving green and environmentally friendly manufacturing process. The high-performance and the high added value of the steel plate are concentrated in that the steel plate has a high strength and an excellent low temperature toughness and weldability, and especially that the steel plate has an excellent fatigue crack growth resistance capability, achieving a low alloying cost and a low cost in manufacturing procedures, and successfully solving a problem in the fatigue crack growth resistance of large heavy steel structures, thus ensuring the safety and reliability of the steel structures in the process of a long-term service; and a good weldability saves the cost of manufacturing a steel component for a user, reduces the difficulty of component making, and shortens the time of manufacture of the steel component for the user, creating a great value for the user, and therefore such a steel plate product with both a high added value and a green environmentally friendly property.

BRIEF DESCRIPTION OF THE DRAWINGS

FIG. 1 is the microstructure (¼ thickness) of Example 3 of the steel plate of the present invention.

DETAILED DESCRIPTION OF EMBODIMENTS

The present invention is further illustrated below in conjunction with examples and drawings.

The components of the steel examples of the present invention are shown in Table 1, and Tables 2 and 3 relate to the process for manufacturing the steel examples of the present invention. Table 4 shows the properties of the steel plates of the present invention.

As can be seen from Table 4 and FIG. 1, the fatigue crack growth-resistant steel plate of the present invention has a yield strength of ≥385 MPa, a tensile strength of 520-630 MPa, a Charpy impact energy (single value) at −40° C. of ≥80 J, and an excellent weldability ($da/dN \leq 3.0\times10^{-8}$ under the conditions of $\Delta K=8$ MPa·$m^{1/2}$). the microstructure of the finished steel plate being a duplex-phase structure of ferrite+ uniformly and dispersedly distributed bainite and having an average grain size of 10 μm or less.

The steel plate of the present invention is obtained by a simple component combination design in conjunction with the TMCP manufacturing process, which not only produces a fatigue crack growth-resistant steel plate (FCA) with an excellent overall performance at a low cost, but also substantially shortens the steel plate manufacturing cycle, creating a tremendous value for enterprises, achieving green and environmentally friendly manufacturing process. The high-performance and the high added value of the steel plate are concentrated in that the steel plate has a high strength and an excellent low temperature toughness and weldability, and especially that the steel plate has an excellent fatigue crack growth resistance capability, achieving a low alloying cost and a low cost in manufacturing procedures, and successfully solving a problem in the fatigue crack growth resistance of large heavy steel structures, thus ensuring the safety and reliability of the steel structures in the process of a long-term service; and a good weldability saves the cost of manufacturing a steel component for a user, reduces the difficulty of component making, and shortens the time of manufacture of the steel component for the user, creating a great value for the user, and therefore such a steel plate product with both a high added value and a green environmentally friendly property.

The steel plate of the present invention is mainly used for hull structures, offshore platforms, sea-crossing bridges, marine wind tower structures, harbour machineries and other large heavy steel structures, and can achieve low-cost, stable bulk industrial productions.

With the development of the national economy in China and the requirements of building a conservation-oriented harmonious society, the marine development has been placed on the agenda, and at present, the marine engineering construction and its related equipment manufacturing industries in China are in the ascendant, so a critical material for the marine engineering construction and its related equipment manufacturing industries—the fatigue crack growth-resistant steel plate has a bright market prospect.

TABLE 1

Unit: weight percentage

| Steel sample | C | Si | Mn | P | S | Cu | Ni | Mo | Ti | Nb | N | Ca |
|---|---|---|---|---|---|---|---|---|---|---|---|---|
| Example 1 | 0.04 | 0.63 | 1.30 | 0.011 | 0.0014 | / | / | / | 0.008 | 0.022 | 0.0033 | 0.0040 |
| Example 2 | 0.06 | 0.40 | 1.45 | 0.009 | 0.0030 | 0.10 | 0.15 | / | 0.011 | 0.015 | 0.0026 | 0.0030 |
| Example 3 | 0.05 | 0.53 | 1.36 | 0.013 | 0.0010 | 0.30 | 0.25 | / | 0.015 | 0.019 | 0.0040 | 0.0025 |
| Example 4 | 0.07 | 0.45 | 1.60 | 0.008 | 0.0012 | / | 0.30 | 0.06 | 0.018 | 0.030 | 0.0031 | 0.0017 |
| Example 5 | 0.06 | 0.07 | 1.55 | 0.009 | 0.0016 | 0.20 | 0.22 | 0.10 | 0.016 | 0.025 | 0.0035 | 0.0022 |

TABLE 2

| Steel plate | | | | Rolling process in the second stage (non-recrystallization controlled rolling) | | | |
|---|---|---|---|---|---|---|---|
| Steel sample | Slab heating Temperature (° C.) | rolling Overall reduction ratio | Rolling process in the first stage (normal rolling) | Start rolling temperature (° C.) | Minimum pass reduction rate (%) | Accumulated reduction rate (%) | Finish rolling temperature (° C.) |
| Example 1 | 1050 | 11 | After the completion of the slab dephosphorization, continuous rolling to a temperature-holding thickness | 840 | 8 | 80 | 790 |

TABLE 2-continued

| Steel sample | Steel plate: Slab heating Temperature (° C.) | Steel plate: rolling Overall reduction ratio | Steel plate: Rolling process in the first stage (normal rolling) | Rolling process in the second stage (non-recrystallization controlled rolling): Start rolling temperature (° C.) | Minimum pass reduction rate (%) | Accumulated reduction rate (%) | Finish rolling temperature (° C.) |
|---|---|---|---|---|---|---|---|
| Example 2 | 1100 | 6.3 | After the completion of the slab dephosphorization, continuous rolling to a temperature-holding thickness | 830 | 7 | 75 | 800 |
| Example 3 | 1080 | 6.7 | After the completion of the slab dephosphorization, continuous rolling to a temperature-holding thickness | 820 | 7 | 67 | 780 |
| Example 4 | 1110 | 5.0 | After the completion of the slab dephosphorization, continuous rolling to a temperature-holding thickness | 790 | 8 | 60 | 770 |
| Example 5 | 1130 | 4.0 | After the completion of the slab dephosphorization, continuous rolling to a temperature-holding thickness | 780 | 7 | 60 | 760 |

TABLE 3

| Steel sample | Controlled cooling process: Starting cooling temperature (° C.) | Controlled cooling process: Cooling rate (K/s) | Controlled cooling process: Cooling-stopping temperature (K) | Slow cooling process Temperature/time | UT flaw detection JB/T 4730 I |
|---|---|---|---|---|---|
| Example 1 | 770 | 25 | 873 | 365° C. × 24 hours | GOOD |
| Example 2 | 790 | 18 | 823 | 370° C. × 24 hours | GOOD |
| Example 3 | 770 | 15 | 773 | 375° C. × 24 hours | GOOD |
| Example 4 | 760 | 12 | 723 | 325° C. × 36 hours | GOOD |
| Example 5 | 750 | 8 | 673 | 315° C. × 36 hours | GOOD |

TABLE 4

| Steel sample | Steel plate: Thickness (mm) | Rel/Rp0.2 MPa | Rm MPa | $\delta_5$ % | transverse impact work Akv (−40° C.)/(J) | Weldability (heat input: 100-125 kJ/cm): Preheating temperature (° C.) | HAZ impact work Akv (−40° C.)/(J) | Fatigue crack growth resistance property: da/dN (mm/number) Under the conditions of $\Delta K = 8\ MPa \cdot m^{1/2}$ |
|---|---|---|---|---|---|---|---|---|
| Example 1 | 20 | 455 | 563 | 26 | 359, 378, 368; 368 | 0 | 196, 263, 206; 222 | $1.2 \times 10^{-8}$ |
| Example 2 | 35 | 462 | 557 | 25 | 335, 360, 365; 353 | 0 | 221, 187, 165; 188 | $1.5 \times 10^{-8}$ |
| Example 3 | 45 | 435 | 566 | 27 | 322, 357, 356; 345 | 0 | 199, 145, 161; 168 | $2.3 \times 10^{-8}$ |
| Example 4 | 60 | 476 | 551 | 25 | 306, 301, 290; 299 | 0 | 202, 124, 173; 166 | $1.7 \times 10^{-8}$ |
| Example 5 | 75 | 483 | 562 | 28 | 285, 288, 285; 286 | 0 | 132, 198, 155; 162 | $2.6 \times 10^{-8}$ |

The invention claimed is:

1. A steel plate having excellent resistance to fatigue crack growth, consisting of, in weight percentage:

C: 0.040-0.070%,
Si: 0.40-0.70%,
Mn: 1.30-1.60%,
P≤0.013%,
S 0.001%-0.003%,
Cu:≤0.30%,
Ni:≤0.30%,
Mo:≤0.10%,
Ti: 0.008-0.018%,
Nb: 0.015-0.030%,
N:≤0.0040%,
Ca: 0.0010-0.0040%, and the balance being Fe and inevitable inclusions; with contents of foregoing elements having to meet all following relationships:

[% C]×[% Si] is controlled in a range of from 0.022 to 0.042;

$\{([\%\ C]+3.33[\%\ Nb])\times[\%\ Si]\}\times V_{cooling\ rate}/T_{cooling\text{-}stopping}$ is controlled in a range of $1.15\times10^{-4}$ to $2.2\times10^{-3}$, wherein $V_{cooling\ rate}$ is an average rate of accelerated cooling performed after a non-recrystallization controlled rolling in unit K/s, and $T_{cooling\text{-}stopping}$ is a stopping temperature of accelerated cooling performed after a non-recrystallization controlled rolling in unit K;

and a Ca treatment is carried out, with the Ca/S ratio being controlled between 1.0 and 3.0 and $Ca \times S^{0.28} \leq 1.0 \times 10^{-3}$ and wherein said steel plate has a yield strength of ≥385 MPa, a tensile strength of 520-630 MPa, a single value of Charpy impact energy at −40° C. of ≥80 J, and $da/dN \leq 3.0 \times 10^{-8}$ under conditions of $\Delta K = 8$ MPa·m$^{1/2}$.

2. The steel plate having excellent resistance to fatigue crack growth of claim 1, characterized in that microstructure of said steel plate is a duplex-phase structure of ferrite+uniformly and dispersedly distributed bainite and has an average grain size of 10 μm or less.

3. A method for manufacturing the steel plate having excellent resistance to fatigue crack growth of claim 1, comprising the following steps:

1) smelting and casting according to the components described in claim 1 to form a slab;

2) heating the slab at a heating temperature between 1050° C. and 1130° C.;

3) rolling the slab with an overall compression ratio of the steel plate, wherein slab thickness/finished steel plate thickness is ≥4.0; wherein the first stage of the rolling is a normal rolling, and the second stage of the rolling is carried out using non-recrystallization controlled rolling with a starting rolling temperature being controlled at 780-840° C., a rolling pass reduction rate being ≥7%, an accumulated reduction rate being ≥60% and a finishing rolling temperature being 760-800° C.; and 4) subjecting the steel plate to accelerated cooling after completion of the controlled rolling, with a starting cooling temperature of the steel plate being 750-790° C., a cooling rate being ≥6° C./s and a cooling-stopping temperature being 400-600° C.; and then allowing the steel plate to be air-cooled to 350° C.±25° C. naturally, followed by a slow cooling process wherein the steel plate is maintained at a temperature for at least 24 hours, and wherein the temperature of the surface of the steel plate is greater than or equal to 300° C.

4. The method for manufacturing the steel plate having excellent resistance to fatigue crack growth of claim 3, wherein the microstructure of the steel plate is a duplex-phase structure of ferrite+uniformly and dispersedly distributed bainite and has an average grain size of 10 μm or less.

5. The method for manufacturing the steel plate having excellent resistance to fatigue crack growth of claim 3, wherein the steel plate has a yield strength of ≥385 MPa, a tensile strength of 520-630 MPa, a single value of Charpy impact energy at −40° C. of 80 J, and $da/dN \leq 3.0 \times 10^{-8}$ under the conditions of $\Delta K = 8$ MPa·M$^{1/2}$.

* * * * *